United States Patent [19]

Carstensen et al.

[11] Patent Number: 4,800,817

[45] Date of Patent: Jan. 31, 1989

[54] RAIL JOINT ALIGNMENT SYSTEM AND METHOD OF CONNECTION

[76] Inventors: Calvin L. Carstensen, 2137 6th Ave., Rapid City, S. Dak. 57702; Randall J. Schommer, P.O. Box 63, Morrill, Nebr. 69358

[21] Appl. No.: 41,596

[22] Filed: Apr. 22, 1987

[51] Int. Cl.[4] ..... E01B 29/46; E01B 29/44

[52] U.S. Cl. ..... 104/2; 104/15; 238/53; 238/151

[58] Field of Search ..... 104/7.2, 15, 2, 8, 16, 104/307; 238/1, 52, 53, 168, 172, 281, 282, 151

[56] References Cited

U.S. PATENT DOCUMENTS

| | | | |
|---|---|---|---|
| 1,557,095 | 10/1925 | Rutledge | 238/52 |
| 2,823,866 | 2/1958 | Jennison | 238/281 |
| 3,731,635 | 5/1973 | Hambrick | 104/15 |
| 3,952,665 | 4/1976 | Stewart et al. | 104/8 |
| 4,251,030 | 2/1981 | Marchant | 238/282 |
| 4,382,547 | 5/1983 | Phillips | 238/281 |

*Primary Examiner*—Robert B. Reeves
*Assistant Examiner*—Joseph D. Pape
*Attorney, Agent, or Firm*—Dean P. Edmundson

[57] ABSTRACT

An alignment system and method are described for aligning and supporting facing ends of two rails so that they can be secured together (e.g., by welding or bonding). The alignment system includes a pair of lift plates to support the ends of the rails. The lift plates are able to adjust the relative vertical positions of the ends of the rails to be joined and are also able to adjust the angular position or attitude of the rail ends. A pair of adjustable gauge members are separately attached at one end to the lift plate and at the opposite end to a rail member parallel to the rails to be joined. The gauge members are adjustable as to length so that the lateral position of the rails to be joined can be determined and controlled. After the ends of the two rails are properly aligned they can be joined together (e.g., by welding or bonding).

22 Claims, 3 Drawing Sheets

RAIL JOINT ALIGNMENT SYSTEM AND METHOD OF CONNECTION

FIELD OF THE INVENTION

This invention relates to railroad track repair and installation techniques. More particularly, this invention relates to techniques and apparatus for aligning and supporting the facing ends of two rails so that they can be welded or bonded together in the field while the rails are in place.

BACKGROUND OF THE INVENTION

Rails in railraod track systems originally were individual sections which were joined together at their ends by means of strap bars bolted to the rails. Each joint constituted a potential weak spot, and the joints present an uneven rolling surface for train cars to ride over.

As a result, a field welding process was brought into use for welding the ends of rail sections together to form a unitary track section many times longer than the length of individual rail segments. By welding several rail segments together, weak spots are eliminated and a smoother track surface is obtained.

The smooth track surface provides less rolling resistance to train cars and, thus, the train engines consume less fuel when travelling over such smooth surface. Also, there is reduced wheel and rail wear. Furthermore, track life is lengthened. The end result of welding the rail sections together is that much upkeep expense is avoided, train operating expense is reduced, and possible accidents are averted.

Although the actual welding process and compositions used in the welding process are now conventional and well accepted, there has not heretofore been provided a simple, accurate and effective system for aligning the rail ends to be joined by welding. Typically, it has been necessary to align the rail ends by driving wedges under the rails until (after trial and error) the desired alignment is obtained. This technique is time-consuming and always subject to various elements of error.

The problems and limitations of the prior alignment technique are overcome with the present invention.

SUMMARY OF THE PRESENT INVENTION

In accordance with the present invention there is provided an alignment system and method for aligning and supporting facing ends of two rails in a manner such that the ends of the rails can be secured together while the rails are in proper alignment.

The alignment system of the invention is easy to use and results in accurate and effective alignment of the rail ends. The system allows rapid alignment without need for driving wedges or relying upon trial and error to achieve the desired results.

In a preferred embodiment the alignment system of the invention comprises:

(a) a pair of lift plates which are adapted to support the ends of the rails to be joined; wherein each lift plate includes first and second clamping means to detachably secure the lift plate to one of the rails; and wherein each lift plate further includes first and second height adjustment means; and (b) a pair of adjustable gauge members, each having first and second ends; wherein each gauge member is adapted to be attached at its first end to one of the lift plates and is adapted to be attached at its second end to a rail member which is parallel to the rails to which the lift plates are secured.

The lift plates are adapted to support the ends of the rails. The vertical and angular orientation or positions of the rail ends can be adjusted and controlled by means of the first and second height adjustment means on the lift plates. The lateral positioning of the ends of the rails can be adjusted and controlled by means of the two gauge members.

With the alignment system of this invention it is possible to very carefully and accurately align the two rail ends to be joined while at the same time providing the proper lateral spacing from the parallel rail in the same track section. As a result, the rails are properly positioned in each direction before they are joined together.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
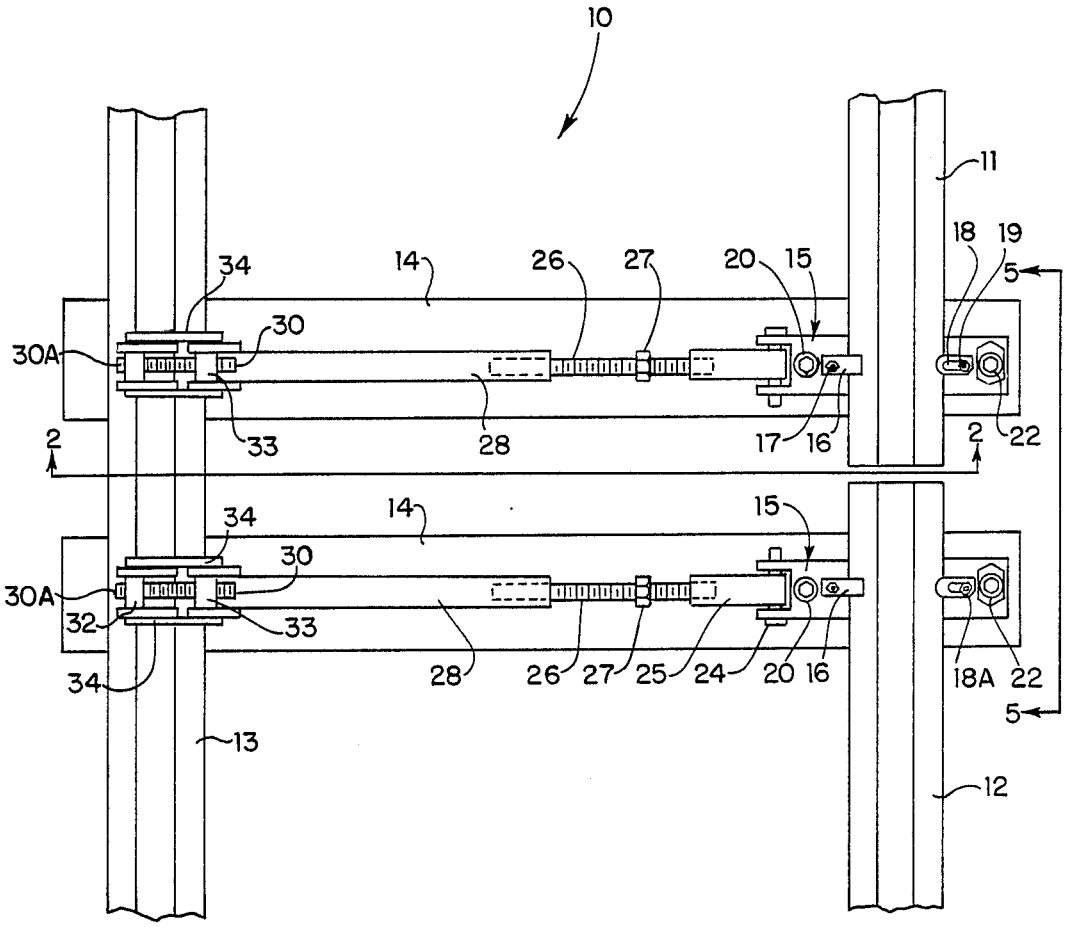
FIG. 1 is a top view illustrating use of the alignment system of the invention in aligning and supporting the ends of two railroad rails which are to be bonded or welded together.

In FIG. 1 there is shown a top view of the preferred alignment system 10 of the invention which is being used to align the ends of two rails 11 and 12 in a track section (i.e., a conventional railroad track section). Rail 13 is spaced from and parallel to rails 11 and 12, as illustrated. Railroad ties 14 extend transversely under the rails on the roadbed.

Positioned under each rail 11 and 12 near the ends of such rails are lift plates 15 which are the same. An adjustable gauge member is attached at one end to each lift plate 15 and is attached or connected at its opposite end to rail 13. Each gauge member is adjustable as to length so that the proper lateral spacing of rails 11 and 12 from rail 13 can be obtained and maintained during the welding process for joining the ends of rails 11 and 12 together.

Each lift plate is detachably secured to the base of a rail by means of clamps 16 and 18. Height adjustment means are carried by each lift plate at opposite ends thereof. On the inner end of the lift plate the height adjustment means is identified as 20, and on the outer end of the lift plate the height adjustment means is identified as 22.

Figure 2:
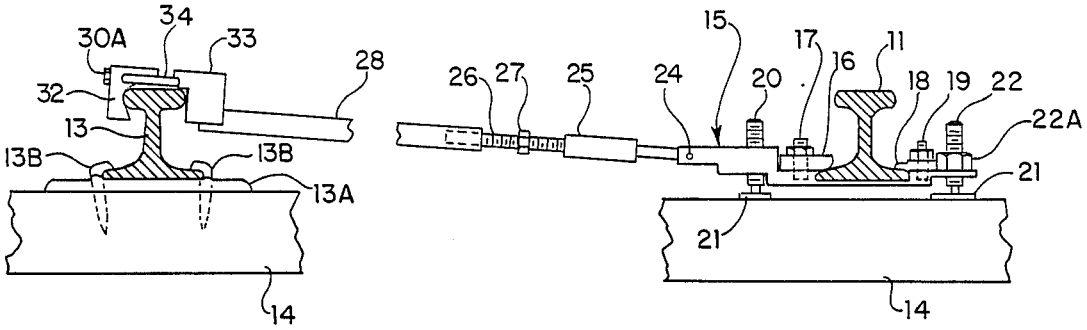
FIG. 2 is a cross-sectional view of the alignment system shown in FIG. 1, taken along line 2—2.

The alignment system is also illustrated in FIG. 2 which is a sectional view taken along line 2—2 in FIG. 1. Clamp 16 includes a bar which projects over the base on one side of rail 11 and is tightened down by means of the threaded nut on stud bolt 17. Clamp 18 includes a bar which projects over the base on the opposite side of rail 11 and is tightened down by means of the threaded nut on stud bolt 19. The stud bolts 17 and 19 are anchored in the lift plate, as illustrated.

Preferably clamp 18 includes an elongated slot through which bolt 19 extends so that the clamp 18 may be easily moved (when loosened) to facilitate fastening of the lift plate 15 to the rail and its subsequent removal. Preferably clamp 18 also includes a rounded or cutaway corner 18A to facilitate rotation of the clamp on bolt 19.

Preferably the lift plate 15 includes a recessed area 15A (illustrated in FIG. 3) into which the base of the rail is received. This provides a very secure and stable support for the rail during the alignment process.

The height adjustment means 20 preferably comprises a threaded rod which is threadably received in a vertical aperture through one end of the lift plate, as illustrated. The upper end of the rod 20 includes a non-circular recess into which a suitable wrench can be inserted for the purpose of rotating rod 20 and causing it to move up or down, as desired, relative to the lift plate.

The height adjustment means 22 also preferably comprises a threaded rod which is threadably received in a vertical aperture through the opposite end of the lift plate, as illustrated. The upper end of the rod 22 also includes a non-circular recess for accommodating a suitable wrench or tool.

The lower end of rod 20 may include a smaller diameter pin 20A, if desired, and the lower end of rod 22 may include a similar pin 22B. When rotating each rod 20 and 22 relative to the lift plate in order to raise the rail 11, the pins 20A and 22B preferably push against flat plates 21 which are supported by railroad tie 14. The plates 21 prevent the pins from sinking into the tie 14.

Figure 4:
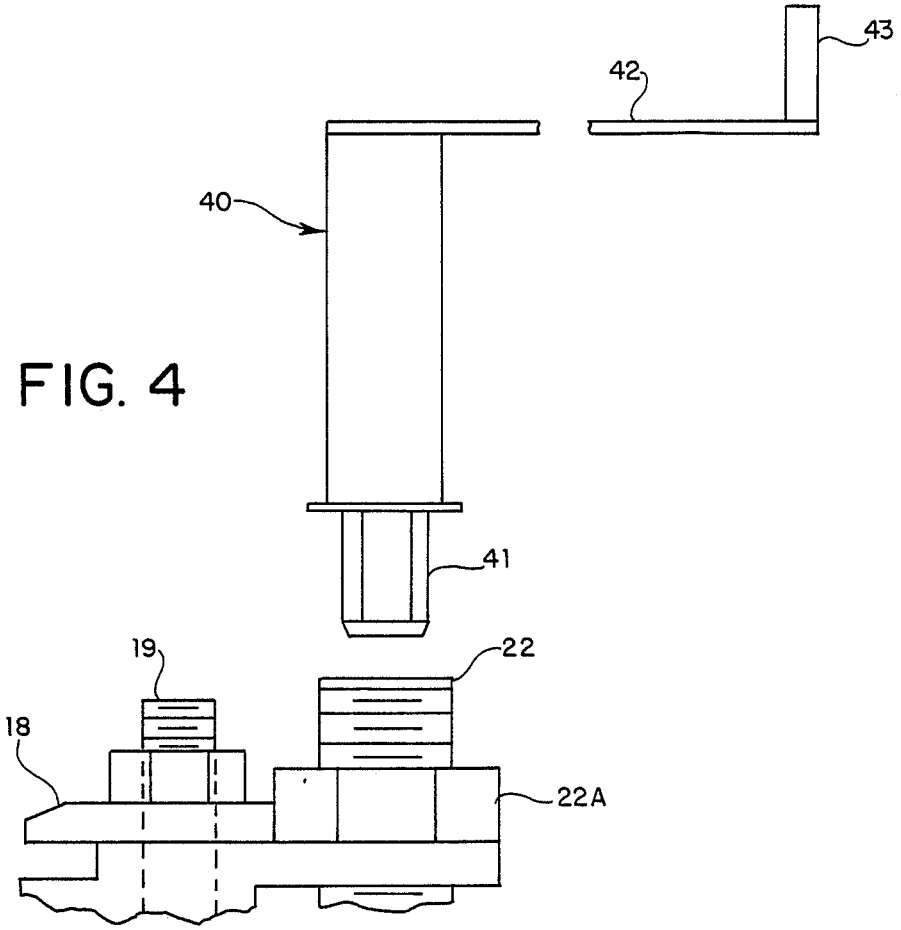
FIG. 4 is a side elevational view illustrating the use of a special wrench to operate the height adjustment means in the alignment system of the present invention.

FIG. 4 illustrates one type of suitable wrench or tool 40 which is very useful for rotating threaded rods 20 and 22. The wrench 40 includes projection 41 at its lower end which is adapted to be inserted into a complementary shaped recess at the top end of the threaded rod. For example, the recess maybe hex-shaped, and the projection 41 may also be hex-shaped to mate with the recess.

At the upper end of tool 40 there is mounted an arm 42 which extends outwardly at a right angle to the main upright portion of the tool. At the outer end of arm 42 a handle 43 is attached. Thus, the lower portion 41 of the tool is easily rotated by means of handle 43.

Figure 3:
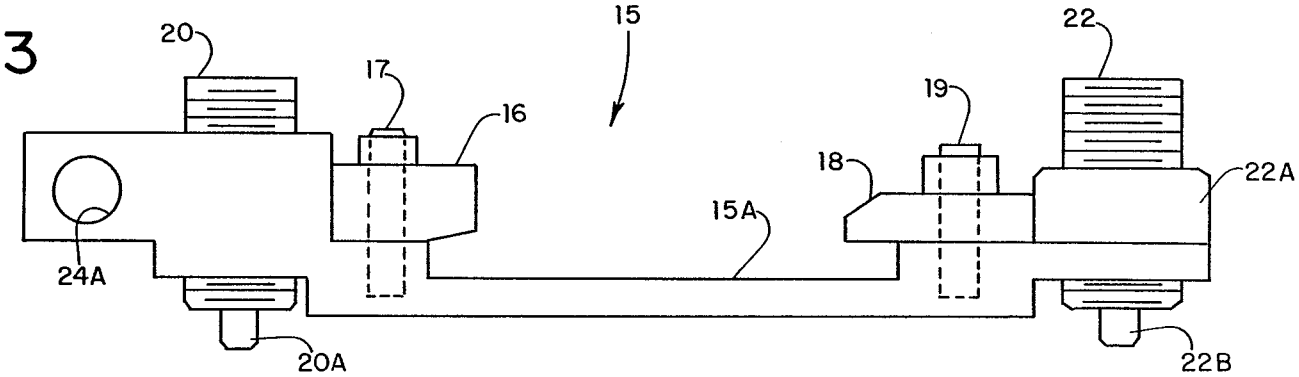
FIG. 3 is a side elevational view of a preferred embodiment of a lift plate which is useful in the alignment system of the invention.
Figure 5:
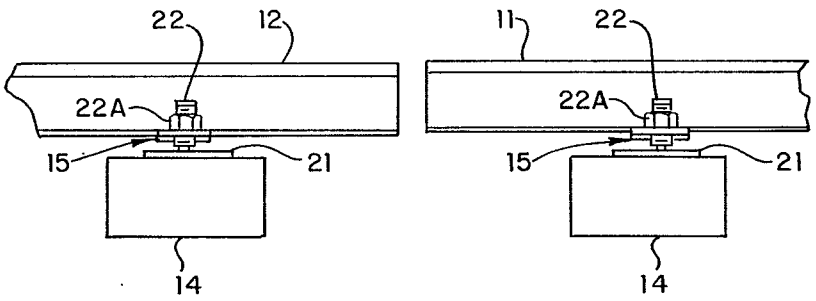
FIG. 5 is a side elevational view of the alignment system shown in FIG. 1, taken along line 5—5.

The gauge member is pivotably attached at one end to lift plate 15 by means of removable pin 24 which extends through apertures 24A at the inner end of the lift plate (illustrated in FIG. 3). The opposite end of each gauge member is attached to rail 13 (illustrated in FIG. 2). Preferably the gauge member includes an adjustable jaw connection member including sections 32 and 33 which are connected to each other by means of threaded bolt 30 having head 30A. Jaw section 33 is securely mounted to he outer end of gauge section 28. By turning head 30A in one direction it is possible to cause jaw member 32 to move outwardly so as to widen the opening between jaw members 32 and 33. By turning the head 30A in the opposite direction it is possible to cause jaw member 32 to move closer to member 33.

Alignment bars 34 extend along the sides of the two jaw sections to keep them in proper alignment at all times. The alignment bars could be secured to either jaw section 32 or jaw section 33 and are adapted to permit one jaw section to slide between them as the jaw section 32 is adjusted.

The jaw member is preferably opened sufficiently wide to enable it to be placed over rail member 13, as illustrated in FIG. 2, after which the jaw may be tightened to firmly attach it to the rail member. Instead of attaching the jaw member to a rail as shown it would also be possible to attach it to any desired fixed object.

The gauge member is adjustable as to length by means of thread shaft 26 connected between gauge sections 25 and 28. Nut 27 is securely fastened to shaft 26. When nut 27 is engaged by a wrench and turned in one direction, shaft 26 draws sections 25 and 28 closer together. In this manner the overall length of the gauge member is decreased. When nut 27 is turned in the opposite direction, shaft 26 forces sections 25 and 28 apart and increases the length of the gauge member.

In this manner the two gauge members are adapted to move the ends of the two rails 11 and 12 laterally. Thus, it is possible to adjust and control the lateral position of rails 11 and 12 during the alignment process.

Vertical and angular alignment of the ends of rails 11 and 12 is accomplished using the height adjustment means on each lift plate. Because each rail is firmly secured to a lift plate, the height adjustment members 20 and 22 enable the end of each rail to be raised, lowered or tilted to one side or the other in order to effect the desired alignment position of the rails to be joined. This is effected very simply, yet accurately and safely.

The alignment system of the invention can be used in either original installation of track or in existing tracks where it is desired to weld adjoining rail segments together.

In existing track environments, the tie plate under each rail to be joined is first removed. The tie plate which has commonly been used in railraod tracks is illustrated in side view in FIG. 2 and denoted 13A. It is shown in normal position between railroad tie 14 and existing rail 13. Spikes 13B extend through openings in the tie plate 13A and secure the rail 13 and the tie plate 13A to railroad tie 14, as illustrated.

In the drawings, the existing tie plate at the end of each of rails 11 and 12 have been removed. Lift plates 15 are positioned under the end of rails 11 and 12 and clamped securely to the rails. It is necessary to provide a gap of about one inch between the facing ends of rails 11 and 12 which are to be welded together. Conventionally a saw is used to cut the ends of the rails to provide the requisite gap Then when the ends of the rails are properly aligned with the alignment system of the invention, firebrick molds are used to close around the gap on all sides except for the top. The molds may also be sealed with a conventional packing material. At this point it is normal to use a gas torch to pre-heat the ends of the rails. Then a crucible containing pre-mixed ingredients (e.g., aluminum powder and other metal materials) is placed over the mold cavity and ignited. After the metal welding composition becomes molten, the metal composition is poured into the mold cavity. After the composition has cooled for a few minutes the crucible and mold jackets are removed. Any excess metal may then be sheared off. When the welded joint has adequately cooled the slag metal is removed and the weld is ground to form a smooth joint. The welding compositions and the welding process are conventional and well-known.

The alignment system of this invention assures that the rail ends are in proper alignment before being welded together. This then assures that the resulting welded joint does not become a weak spot in the continuous rail system.

The alignment system can be used on any type or size of rails and under any track conditions. It is safe to use, and it eliminates the need for driving wedges under rails. Because no spikes need to be used with the system, the life of railraod ties is improved.

Typically the proper alignment of rail ends can be achieved in a matter of a few minutes with this system, thus allowing it to be used even in high traffic areas without undue interference with normal train traffic. Also, the alignment system can be used by one person, if desired, which reduces the total cost of obtaining welded joints.

Other variants are possible without departing from the scope of the present invention.

What is claimed is:

1. An alignment system for aligning and supporting facing ends of two rails in a manner such that said ends of said rails can be secured together while said rails are in proper alignment, said alignment system comprising:

(a) a pair of lift plates; wherein one said lift plate is adapted to support one said end of one said rail while the other said lift plate is adapted to support one said end of the other said rail; wherein each said lift plate includes first and second clamping means which are adapted to detachably secure said lift plate to a said rail; wherein each said lift plate further includes first and second height adjustment means; and (b) a pair of adjustable gauge members, each having first and second ends; wherein each gauge member is adapted to be pivotably attached at its first end to one of said lift plates and is adapted to be attached at its second end to a rail member which is parallel to the rails to which said lift plates are secured; wherein each said gauge member includes length adjustment means;

wherein said lift plates are adapted to support said ends of said rails; wherein the relative positions of said ends of said rails can be adjusted by said height adjustment means of each said lift plate; and wherein the position of said ends of said rails relative to said parallel rail member can be adjusted by means of said gauge members.

2. An alignment system in accordance with claim 1, wherein each said lift plate includes inner and outer ends; wherein said first height adjustment means comprises a first threaded rod which threadably engages said inner end of said lift plate; wherein said second height adjustment means comprises a second threaded rod which threadably engages said outer end of said lift plate; and wherein said adjustable gauge members are attached to said inner ends of said lift plates.

3. An alignment system in accordance with claim 2, wherein each said lift plate includes a recessed area between said inner and outer ends; wherein said recessed area is adapted to receive a said rail.

4. An alignment system in accordance with claim 3, wherein said first and second clamping means are secured to said lift plate at opposite ends of said recessed area.

5. An alignment system in accordance with claim 4, wherein said second clamping means comprises a retention member which includes an elongated slot, wherein said retention member is connected to said lift plate by means of a threaded fastener which extends through said elongated slot.

6. An alignment system in accordance with claim 1, wherein said length adjustment means comprises a threaded shaft connecting between said first and second ends of said gauge member; wherein said threaded shaft threadably engages at least one of said ends of said gauge member; and wherein rotation of said threaded shaft in one direction shortens the length of said gauge member and rotation of said threaded shaft in the opposite direction lengthens said gauge member.

7. An alignment system in accordance with claim 1, wherein said second end of said gauge member includes adjustable connection means.

8. An alignment system for aligning and supporting facing ends of two rails in a manner such that said ends of said rails can be secured together while said rails are in proper alignment, said alignment system comprising:

(a) a pair of lift plates; wherein one said lift plate is adapted to support one said end of one said rail while the other said lift plate is adapted to support one said end of the other said rail; wherein each said lift plate includes first and second clamping means which are adapted to detachably secure said lift plate to a said rail; wherein each said lift plate further includes first and second height adjustment means; and (b) a pair of adjustable gauge members, each having first and second ends; wherein each said gauge member is adapted to be pivotably attached at its first end to one of said lift plates and is adapted to be attached at its second end to a fixed object which is spaced laterally from said ends of said rails; wherein each said gauge member includes length adjustment means;

wherein said lift plates are adapted to support said ends of said rails; wherein the vertical and angular positions of said ends of said rails can be adjusted by said height adjustment means of said lift plates; and wherein the lateral positions of said ends of said rails can be adjusted by means of said gauge members.

9. An alignment system in accordance with claim 8, wherein each said lift plate includes inner and outer ends; wherein said first height adjustment means comprises a first threaded rod which threadably engages said inner end of said lift plate; wherein said second height adjustment means comprises a second threaded rod which threadably engages said outer end of said lift plate; and wherein said adjustable gauge members are attached to said inner ends of said lift plates.

10. An alignment system in accordance with claim 9, wherein each said lift plate includes a recessed area between said inner and outer ends; wherein said recessed area is adapted to receive a said rail.

11. An alignment system in accordance with claim 9, wherein said second clamping means comprises a retention member which includes an elongated slot, wherein said retention member is connected to said lift plate by means of a threaded fastener which extends through said elongated slot.

12. An alignment system in accordance with claim 8, wherein each said adjustable gauge member includes a threaded shaft connecting between said first and second ends of said gauge member; wherein said threaded shaft threadably engages at least one of said ends of said gauge member; and wherein rotation of said threaded shaft in one direction shortens the length of said gauge member and rotation of said threaded shaft in the opposite direction lengthens said gauge member.

13. An alignment system in accordance with claim 8, wherein said second end of said gauge member includes adjustable jaw connection means.

14. An alignment system in accordance with claim 8, wherein said adjustable gauge members are each adapted to be attached at said second end to a third rail which is parallel to said rails to be secured together.

15. A method for aligning and supporting facing ends of two rails in a manner such that said ends of said rails can be secured together while said rails are in proper alignment, said method comprising the steps of:

(a) providing a pair of lift plates, each of which includes first and second clamping means which are adapted to detachably secure said lift plate to said rail; wherein each said lift plate further includes first and second height adjustment means;

(b) positioning a said lift plate under said end of each said rail and securing said lift plate to said rail;

(c) providing a pair of adjustable gauge members, each having first and second ends;

(d) attaching said first end of each said gauge member to a said lift plate;

(e) attaching said second end of each said gauge member to a fixed object laterally spaced from said ends of said rails;

(f) laterally aligning said ends of said rails by means of said adjustable gauge members; and (g) vertically and angularly aligning said ends of said rails by means of said height adjustment means.

16. A method in accordance with claim 15, wherein said fixed object is a third rail which is parallel to said rails to be secured together.

17. A method in accordance with claim 15, wherein each said gauge member includes length adjustment means comprising a threaded shaft connecting between said first and second ends of said gauge member; wherein said threaded shaft threadably engages at least one of said ends of said gauge member; and wherein rotation of said threaded shaft in one direction shortens the length of said gauge member and rotation of said threaded shaft in the opposite direction lengthens said gauge member.

18. A method in accordance with claim 15, wherein each said lift plate includes inner and outer ends; wherein said first height adjustment means comprises a first threaded rod which threadably engages said inner end of said lift plate; wherein said second height adjustment means comprises a second threaded rod which threadably engages said outer end of said lift plate; and wherein said adjustable gauge members are attached to said inner ends of said lift plates.

19. A method in accordance with claim 18, wherein each said lift plate includes a recessed area between said inner and outer ends; wherein said recessed area is adapted to receive a said rail.

20. A method in accordance with claim 19, wherein said first and second clamping means are secured to said lift plate at opposite ends of said recessed area.

21. A method in accordance with claim 20, wherein said second clamping means comprises a retention member which includes an elongated slot, wherein said retention member is connected to said lift plate by means of a threaded fastener which extends through said elongated slot.

22. A method in accordance with claim 15, further comprising the step of welding said ends of said rails together.

* * * * *